US006371539B1

(12) United States Patent
Olshausen

(10) Patent No.: US 6,371,539 B1
(45) Date of Patent: Apr. 16, 2002

(54) TAMPER-EVIDENT SEAL WITH INDEPENDENTLY-SEVERABLE, LINEAR RATCHETS AND REUSABLE, CLASP-BEARING CATCHES

(76) Inventor: Michael Cohnitz Olshausen, P.O. Box 2075, Bristol, PA (US) 19007

( * ) Notice: Subject to any disclaimer, the term of this patent is extended or adjusted under 35 U.S.C. 154(b) by 5 days.

(21) Appl. No.: 09/602,337

(22) Filed: Jun. 24, 2000

Related U.S. Application Data

(63) Continuation-in-part of application No. 09/369,350, filed on Aug. 6, 1999, now Pat. No. 6,109,673.

(51) Int. Cl.[7] ..... B65D 27/30

(52) U.S. Cl. ..... 292/307 R; 292/315

(58) Field of Search ..... 292/307 A, 307 R, 292/317–321, 325, 316, 322; 24/573.1; 40/628; 283/105

(56) References Cited

U.S. PATENT DOCUMENTS

| | | | | | |
|---|---|---|---|---|---|
| 1,012,882 | A | * | 12/1911 | Martineau | 292/318 |
| 1,365,477 | A | * | 1/1921 | Gabriel | 292/307 A |
| 4,071,023 | A | * | 1/1978 | Gregory | 129/133 |
| 4,910,831 | A | * | 3/1990 | Bingold | 24/16 PB |
| 5,765,885 | A | * | 6/1998 | Netto | 292/318 |
| 6,189,249 | B1 | * | 2/2001 | Hughes | 40/662 |

* cited by examiner

*Primary Examiner*—Gary Estremsky

(57) ABSTRACT

A tamper-evident seal having dual, reusable catches and a seal element adapted lockably to engage either of the catches, the extent of this engagement being, furthermore, adjustable without thereby rendering the seal itself reusable, once it has been broken. The two catches may each bear an integrally-formed, clasp-like structure, which facilitates the attachment of the catches and, consequently, of the tamper-evident seal, to a variety of external devices. Both the seal and the catches have a generally squared-off design, which helps to reduce mold-making costs by adding a degree of freedom to the placement of the parting lines.

17 Claims, 2 Drawing Sheets

*Fig.6*
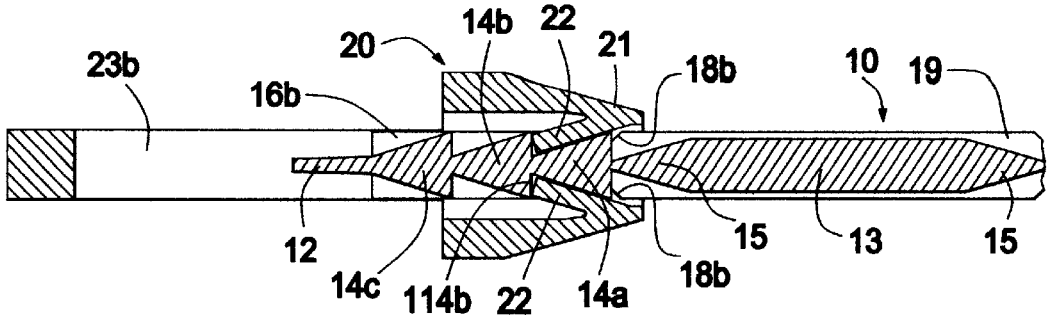
*Fig.7*
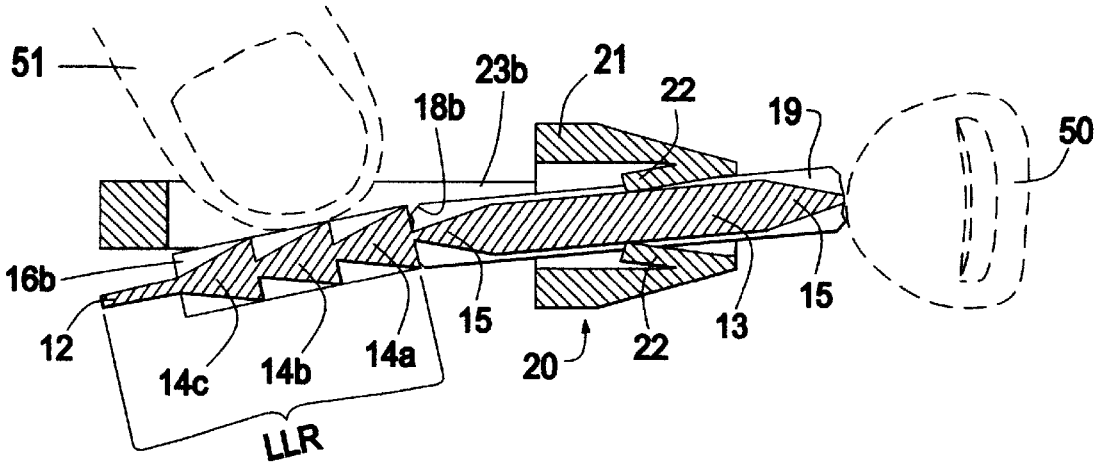
*Fig.8*
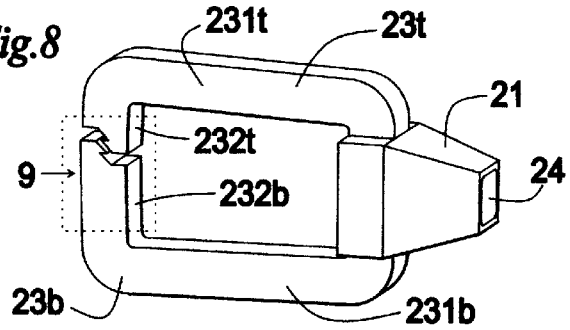
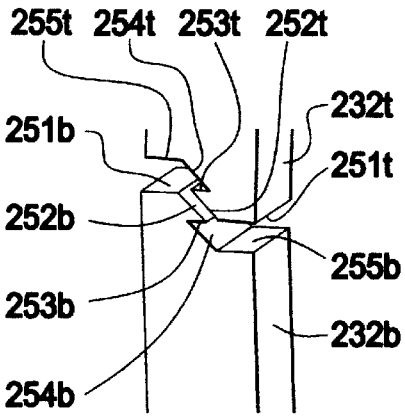
*Fig.9*
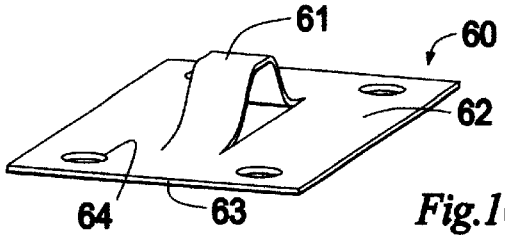
*Fig.10*

TAMPER-EVIDENT SEAL WITH INDEPENDENTLY-SEVERABLE, LINEAR RATCHETS AND REUSABLE, CLASP-BEARING CATCHES

CROSS-REFERENCE TO RELATED APPLICATIONS

U.S. patent application Ser. No. 09/369,350, now U.S. Pat. No. 6,109,673.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This is a Continuation in Part of U.S. patent application Ser. No. 09/369,350 filed Aug. 6, 1999 now U.S. Pat. No. 6,109,673. The art in which the present invention resides thus is likewise broadly defined by tamper-evident seals that are at least in part reusable.

The present invention extends and amplifies the art disclosed in the parent application by offering improved adjustability, reduced cost of manufacture, and easier application to external devices. As before, in the parent application, the present invention has two, reusable catches, but now adds an engaging-element whose engagement-length is adjustable, yet which has, with respect to each catch, a unique, weakest point for that catch, so located as to prevent reuse of the engaging-element once it has been broken.

Security devices having dual catches, and further having engaging-elements whose engagement-length is individually adjustable at each catch are well known. A bilaterally symmetric device having two catches and two, adjustable-length, linear ratchets is taught by U.S. Pat. No. 4,910,831 to Bingold (1990). Bingold's device, however, does not provide weak points at which its respective linear ratchets sever preferentially from the overall device. The severing from Bingold's device of his linear ratchets would, in fact, destroy the utility of Bingold's device, because it is intended to function as a handcuff.

BRIEF SUMMARY OF THE INVENTION

The present invention provides an engaging-element, referred to in shorthand-manner as the "seal", comprising a long mid-section and two linear ratchets, one each abutting the opposite ends of the mid-section, each linear ratchet in itself further comprising a plurality of abruptly shouldered sub-elements. The long mid-section and each of the two, linear ratchets further respectively comprise a pair of parallel side rails. The parallel side rails of each linear ratchet help to prevent the linear ratchet from breaking at any one of the several junctions of its successive, abruptly-shouldered sub-elements when stressed.

Taken together, the long mid-section and the two linear ratchets form the top portion of the engaging-element. In the present invention, this top portion has two, least cross-sectional areas, these being coincident with the junctions of the linear ratchets with the long mid-section. A tugging force applied to the seal's top portion at either end, such as a force tending to pull the catches of the present invention apart after the seal has been brought into lockable engagement with both catches, thus will sever one or the other of the linear ratchets in its entirety from the remainder of the seal, rather than severing one or the other of the linear ratchets internally, at one of the junctions between two of its adjacent, abruptly-shouldered sub-elements.

The greatest cross-section of the seal's mid-section orthogonal to its length is geometrically substantially similar to (it is H-shaped in the embodiment herein illustrated) to the greatest, parallel cross-section of either of the linear ratchets, and is furthermore not greater than this cross-section in either area or longest dimension. These cross-sectional relationships allow the mid-section to pass easily on its own through either catch.

Attached to the mid-section is an identification element which, as in the parent application, may be torn off by a twisting force applied substantially orthogonally to the force needed to sever either of the linear ratchets from the engaging-element.

The catches, in order to be reusable, are injection molded out of a rugged thermoplastic, such as nylon or polycarbonate. The engaging-element is injection molded out of a much weaker, more elastic material, polypropylene for example.

The engaging-element illustrated herein is bilaterally symmetric, although one of its linear ratchets might be made longer than the other, should such an asymmetry suit a particular purpose.

Each catch of the present invention bears an asymmetric, clasp-like feature that allows easy attachment of the catch to a variety of external devices. The present invention furthermore displays, if one may so speak, a generally square aesthetic, as opposed to the organic, rounded aesthetic of the parent invention. This squaring-off of elements can help to reduce mold-making costs, inasmuch as parting lines can now be positioned with one greater degree of freedom.

With the foregoing in mind, it is an important object of the present invention to offer a tamper-evident seal that is easily and bilaterally adjustable.

It is yet another object of the present invention to permit this adjustability and yet to prohibit the reuse of the engaging-element.

It is yet another object of the present invention to provide a tamper-evident seal having multiply-reusable catches that may be easily attached to a variety of external devices.

It is still a further object of the present invention to reduce mold-making costs.

These and yet further objects and advantages of the present invention will become apparent from a consideration of the following, detailed specification, drawings, and appended claims.

BRIEF DESCRIPTION OF THE SEVERAL VIEWS OF THE DRAWING

Referring to the drawings, wherein like reference characters indicate like parts or elements throughout the several views, and in which solid arrowheads point to compound objects whose numbered resolution into constituent parts occurs when it is germane to the discussion:

FIG. 6 is a cross-sectional view of the embodiment shown in FIG. 1 after one of the symmetric ends of the element shown in FIG. 2 has been severed and the catch element previously in engagement with that severed end has been omitted and taken along line 6—6 of FIG. 1 and drawn to the scale of FIG. 3.

FIG. 7 shows the elements in FIG. 6 in the same scale and additionally includes two, schematic, human fingers.

FIG. 8 is a perspective view of one of the catch elements of the embodiment shown in FIG. 1 subsequent to that catch element's manufacture but prior to its use and drawn to the scale of FIG. 1.

FIG. 9 is an enlarged view of the portion of FIG. 8 within dotted box 9.

FIG. 10 is a perspective view of a device external to the present invention and to which it may be attached drawn to the scale of FIG. 8.

DETAILED DESCRIPTION OF THE INVENTION

Figure 1:
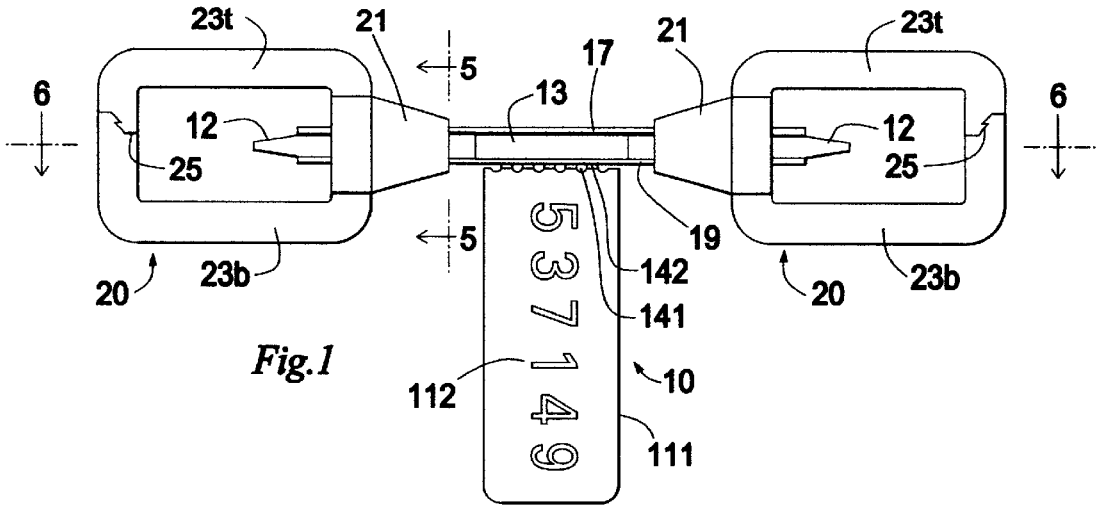
FIG. 1 is an elevation front view of the preferred embodiment of the present invention, showing the elements thereof in locked engagement with one another.

FIG. 1 shows a tamper-evident seal comprising engaging-element 10 and two congruent, catch elements 20. Engaging-element 10 comprises mid-section core 13 and mid-section bottom side rail 19 and mid-section top side rail 17. Engaging-element 10 further comprises tear-off, identification element 111 having serial number 112. ID element 111 is attached to mid-section bottom side rail 19 by perforation teeth 142 separated by perforation holes 141. ID element 111 could very easily be attached by other means, such as a row of thin, staggered elements, as disclosed in FIG. 10 of the parent application. An abscission bead is formed in either case that allows tag 111 easily to be torn off mid-section bottom side rail 19.

Each catch element 20 has catch housing 21 and top and bottom arms 23*t* and 23*b*, respectively, which, in the embodiment of the invention shown in FIG. 1, lend to catches 20 substantially the appearance of square-cross section chain links. Arms 23*t* and 23*b* meet at junction 25. The plane that defines FIG. 6, located by line 6—6 of FIG. 1, cuts catch housings 21 through their joint midline, which is also the midline of mid-section core 13. Junction 25, however, lies to one side of line 6—6. That is, arms 23*t* and 23*b* are asymmetric.

At the far, that is opposite, ends of the top portion of engaging-element 10 are tapered tongues 12, which guide the insertion of engaging-element 10 into the catches 20.

Figure 2:
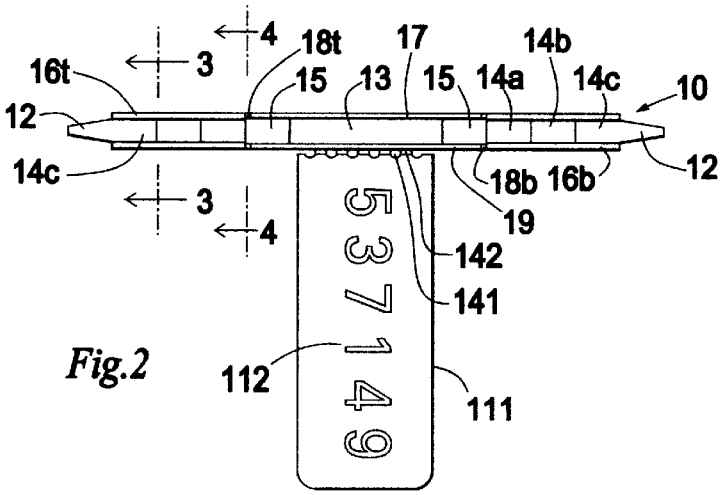
FIG. 2 is an elevation front view of the bilaterally symmetric, central element of the embodiment shown in FIG. 1.

FIG. 2 reveals that engaging-element 10 additionally comprises tapered ends 15 (preview FIG. 6) of mid-section core 13. Tapered ends 15, together with mid-section top side rail 17, mid-section bottom side rail 19, and mid-section core 13 are the mid-section of engaging-element 10. Small notches 18*t* are cut away from mid-section top side rail 17, two notches at either end (preview FIG. 4), and similar, small notches 18*b* are cut away from mid-section bottom side rail 19, again two at either end. Side rails 17 and 19 being parallel and in registry and equally long, the pair of notches 18*t* at either mid-section end is in planar registry with the pair of notches 18*b* (preview FIG. 4) at that same end.

Figure 3:
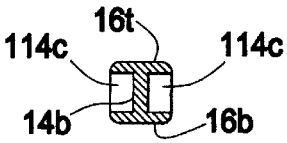
FIG. 3 is a cross-section of the element shown in FIG. 2 taken along line 3—3 of FIG. 2 and enlarged in scale.

Abutting each end of mid-section top side rail 17 is a ratchet top side rail 16*t*, and abutting each end of mid-section bottom side rail 19 is a ratchet bottom side rail 16*b* congruent to rail 16*t* in registry above it (preview FIG. 3). Between, and integrally formed with, rails 16*t* and 16*b* is a set of abruptly-shouldered sub-elements, here of equal length (preview FIG. 6) and three in number, namely sub-elements 14*a*, 14*b*, and 14*c*. For the embodiment of the present invention herein illustrated, a linear ratchet is thus understood to consist of one set of abruptly-shouldered sub-elements 14*a*, 14*b*, and 14*c*, plus their adjacent top and bottom side rails 16*t* and 16*b*, plus tongue 12, in which the sub-element 14*c* terminates. Engaging-element 10, being bilaterally symmetric, has two such linear ratchets.

When engaging-element 10 is not in engagement with either of the catches 20 it is non-contiguous with both of them, that is, it may be carried about as a separate object, independent of the catches.

FIG. 3 is a cross-section taken ever so slightly to one side of (to the right of in FIG. 2) a junction between two adjacent, abruptly-shouldered sub-elements of a linear ratchet, here, for specificity's sake, between 14*c* and 14*b* of the left ratchet. Of sub-element 14*c* we see only its exposed, symmetric surfaces 114*c*, and of sub-element 14*b* we see only its smallest cross-section. Surfaces 114*c* together define the greatest width of abruptly-shouldered sub-element 14*c*. Sub-element 14*b* has corresponding surfaces 114*b* (illustrated in FIG. 6), each identical in area to surfaces 114*c*. Top side rail 16*t* and bottom side rail 16*b* lend rigidity to the junction of adjacent sub-elements 14*c* and 14*b*, that is, the rails keep the junction from being unduly fragile.

Figure 4:
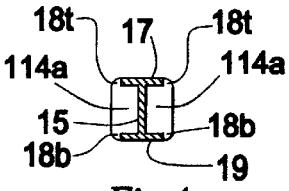
FIG. 4 is a cross-section of the element shown in FIG. 2 taken along line 4—4 of FIG. 2 and in the scale of FIG. 3.

FIG. 4 is a cross-section taken ever so slightly to one side of (to the right of in FIG. 2) a junction of one of the tapered ends 15 (the leftmost in FIG. 2) with the adjacent, abruptly shouldered sub-element 14*a*. Of 14*a* we see only its exposed, symmetric surfaces 114*a*, which together define the greatest width of abruptly-shouldered sub-element 14*a*. Although this greatest width of 14*a* is identical to the greatest width of sub-elements 14*a* and 14*b*, surfaces 114*a* are seen to be significantly greater in area than surfaces 114*c* in FIG. 3. Another way of saying this is that tapered end 15 has a smaller, least cross-section than any of the sub-elements 14*a*, 14*b*, or 14*c*, and that mid-section top and bottom side rails 17 and 19 have a combined cross-section that is smaller than the combined cross-section of ratchet top and bottom side rails 16*t* and 16*b*. The cross-section shown in FIG. 4 thus has the smallest cross-sectional area of any cross-section taken orthogonally to the side rails of engaging-element 10 (compare the hatched portion of FIG. 4 to the hatched portion of FIG. 3). These cross-sectional relations insure that the linear ratchets will break off in their entirety from the mid-section of engaging-element 10 when engaging-element 10 is lockably engaged with both catches 20 and a force is applied to the catches 20 tending to pull them apart. To further facilitate this breakage under stress of engaging-element 10 at the junction shown in FIG. 4, a pair of top notches 18*t* and a pair of bottom notches 18*b* are located at this junction as well.

Figure 5:
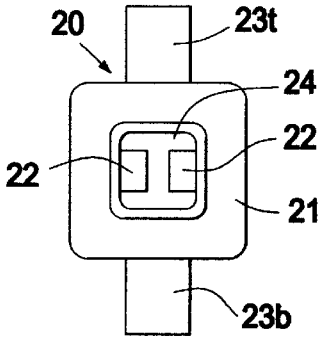
FIG. 5 is a front plan view of one of the two, like, catch elements of the embodiment shown in FIG. 1 taken along line 5—5 of FIG. 1 and omitting the element shown in FIG. 2 and drawn to the scale of FIGS. 3 and 4.

FIG. 5 is a view through "H-shaped" aperture 24 of catch housing 21. Bilaterally symmetrically placed within aperture 24 are resilient, converging elements 22, typically called fingers, that allow the passage of either of the linear ratchets past them in one direction only. In particular, any of the abruptly-shouldered elements (in the embodiment of the present invention herein illustrated any of the sub-elements 14*a*, 14*b*, or 14*c* of either the left, or of the right, linear ratchet) may pass through aperture 24 and past fingers 22

(preview FIG. 6). However, following a particular sub-element's passage past fingers 22, fingers 22 spring back behind that sub-element's abrupt shoulder, thus preventing movement of the linear ratchet as a whole in the opposite direction. What would the world come to without resiliency?

FIG. 6 depicts the left linear ratchet in locked engagement with catch 20. Sub-element 14*b* has passed resilient fingers 22, which in turn have sprung back behind it so that they now abut surfaces 114*b,* thus preventing movement of sub-element 14*b,* and hence of the left linear ratchet, out of catch 20, that is, to the right in the figure. In FIG. 6, the right linear ratchet is missing, having in its entirety been broken off engaging-element 10 by some force earlier applied to the catches 20. Mid-section core 13 is revealed to be appreciably less wide than mid-section bottom side rail 19, and therefore to be appreciably narrower than the greatest width of any of the abruptly-shouldered sub-elements 14*a,* 14*b,* or 14*c.* Tapered ends 15 of core 13 are equal to it in maximum width.

FIG. 7 shows the remainder of engaging-element 10 shown in FIG. 6 but now subsequent to the further removal of identification element 111. Human fingers 50 and 51 urge and guide this reduced remainder of engaging-element 10 through catch 20. The width of core 13 being appreciably narrower than the greatest width of any of the abruptly-shouldered sub-elements 14*a,* 14*b,* or 14*c,* the mid-section of engaging-element 10 easily passes between fingers 22 and thus easily on and through catch 20. Finger 51 presses a bit on left linear ratchet LLR so as to guide tongue 12 past bottom rear leg 232*b* (preview FIG. 8) of arm 23*b.* In so doing, the material of the reduced remainder of engaging-element 10 may be stressed just sufficiently to cause the junction of ratchet LLR with the seal's mid-section to tear a bit at one of the bottom notches 18*b,* as shown in the figure. Whether such a tearing actually occurs or whether just a stretching occurs will depend on the plasticity of the seal and on the depth of notches 18*b.*

FIG. 8 shows one of the catches 20 after its manufacture but prior to its actual use. Arms 23*t* and 23*b* are each joined to catch housing 21 and are seen to be spaced apart just sufficiently that they do not touch. The angle between them in FIG. 8 is 3°. Top arm 23*t* comprises top, lengthwise leg 231*t* and top, short, rear leg 232*t.* Bottom arm 23*b* comprises bottom, lengthwise leg 231*b* and bottom, long, rear leg 232*b.* Arms 23*t* and 23*b* are thus asymmetric.

FIG. 9 shows in detail the clasp-like mechanism of catch 20. Bottom long rear leg 232*b* terminates in a stepped, serrated end, of which a congruent copy, rotated 180°, forms the adjacent end of top short rear leg 232*t.* Arms 23*t* and 23*b,* when pressed together forcefully enough to induce a temporary, plastic deformation or their stepped, serrated ends, will interlock. The stepped, serrated end of leg 232*b* has parallel flat faces 251*b* and 255*b,* orthogonal to leg 232*b.* Oblique, flat face 252*b* intersects face 251*b,* and oblique, flat face 254*b,* parallel to face 252*b,* intersects face 255*b.* Oblique faces 252*b* and 254*b* extend just past, and on opposite sides of, the mid-line of leg 232*b,* and are connected by flat face 253*b,* parallel to faces 251*b* and 255*b.* All of these five, flat faces are exactly repeated at the end of leg 232*t* and thus are numbered identically, with the suffix b however being replaced by the suffix t. When arms 23*t* and 23*b* are pressed together, faces 252*t* and 252*b* slide along upon one another, all the while loading stress into arms 23*t* and 23*b,* until the moment when the edges at the intersections of faces 252*t* and 252*b* with faces 253*t* and 253*b,* respectively, just slide by each other, whereupon the induced stress is partly relieved as the arms' stepped, serrated, clasp-like ends snap into interlocking engagement. Some residual, deformation-stress, a result of the arms' rotation, each through an angle of about 1.5° from its original, cast position, will remain in arms 23*t* and 23*b,* as well as in catch housing 21. This residual stress stays in the structure, much like the static stress contained within arches holding up an aqueduct. A drop of capillary cement on the junction of arms 23*t* and 23*b* will join them essentially permanently (this works quite well for polycarbonate), or they might, for example, be near-field, ultrasonically welded (this works well for nylon and the polycarbonate).

FIG. 10 shows external device 60, here a metal stamping in the form of a flat staple, to which catch 20 may easily be connected. Device 60 has flat staple 61, which extends above surface 62 of base plate 63. Holes 64 allow device 60 to be mounted, as by rivets, to some other device, for example a storage-compartment door. Catch 20 is just able to rotate freely within flat staple 61.

Catch 20, because its rear legs are of unequal length, can be slipped more easily, that is, with less deformation, over staple 61 than it could be were its legs 232*t* and 232*b* equal in length. Furthermore, if, instead of a flat staple, a round-cross section chain link were to be embraced by catch 20, and if catch 20 itself, instead of resembling a square chain link resembled a more oval chain link, yet still had asymmetric arms, then a pulling force applied to catch 20 would be transmitted to the junction of those arms not nearly as directly as it would be were those arms bilaterally symmetric, that is, were their junction to lie on the mid-line of catch 20. Asymmetry in the more-rounded case safeguards the junction.

The present invention might be optionally supplied with a set of engaging-elements having more than one color. Security may be enhanced inexpensively through impromptu, seal-color changes.

Inasmuch as modifications and alterations apparent to one skilled in the art may be made in the herein described embodiment of the present invention without departing from the scope and spirit thereof, it is intended that all matter contained herein be interpreted in an illustrative, and not in a limiting, sense with respect to the invention claimed in the following claims and equivalents thereto.

I claim:

1. A tamper-evident seal comprising an engaging-element and two catch-elements, said engaging-element being adapted to lockably engage either, or both, of said catch-elements, said engaging-element having a midsection and an identification element attached thereto, said engaging-element further having two linear ratchets, each said linear ratchet comprising a plurality of abruptly-shouldered sub-elements, each said plurality having a unique member that is closer to said midsection than any other member, said abruptly-shouldered sub-elements being individually capable of passing through either of said catch-elements, said passing of said abruptly-shouldered sub-elements through either of said catch-elements being permitted in one direction but, after having occurred, being obstructed from occurring in the opposite direction, said midsection of said engaging-element being adapted to pass in its entirety through one of said catch-elements after one of the said linear ratchets has been severed from the said engaging-element, said engaging element being adapted to facilitate said severing preferentially to occur between said unique member and said midsection, and after the said identification element has been removed from said engaging-element.

2. A tamper-evident seal as in claim 1 wherein said midsection has a longest dimension and a cross-sectional area orthogonal to said longest dimension, and in which each said linear ratchet has a maximum cross-sectional area parallel to said cross-sectional area of said midsection, and in which said cross-sectional area of a said midsection is geometrically substantially similar to, and is not greater than, said maximum cross-sectional area of either of said linear ratchets.

3. A tamper-evident seal as in claim 1 wherein each of said linear ratchets is attached to said midsection at a junction, and in which each said junction has a cross-sectional area, and in which said cross-sectional area of each said junction is less than any cross-sectional area of either said mid-section or of said linear ratchets that is not also a cross-sectional area of one of said junctions.

4. A tamper-evident seal as in claim 3 wherein said cross-sectional area of said junction is substantially H-shaped.

5. A tamper-evident seal as in claim 3 wherein said mid-section has at least one notch at each said junction.

6. A tamper-evident seal as in claim 1 wherein said identification element is attached to said midsection by an abscission bead, said abscission bead being readily torn when some minimally necessary force is applied to said identification element, said minimally necessary force, however, being insufficient to tear any other elements of said tamper-evident seal, apart from said abscission bead, when said engaging-element is in said locking engagement with either, or with both, of said catch-elements.

7. A tamper-evident seal as in claim 1 wherein the materials from which each of said catch elements is manufactured are jointly more rugged than the material from which said engaging-element is manufactured.

8. A tamper-evident seal as in claim 7 wherein said engaging-element is made of polypropylene.

9. A tamper-evident seal as in claim 7 wherein at least one of said catch elements is made of nylon.

10. A tamper-evident seal as in claim 7 wherein at least one of said catch elements is made of polycarbonate.

11. A tamper-evident seal as in claim 1 wherein said engaging-element is drawn from a replacement set, said replacement set contains a plurality of said engaging-elements, and the colors of said engaging-elements in said replacement set are not all the same.

12. A tamper-evident seal comprising an engaging-element and two catch-elements, said engaging-element being adapted lockably to engage either of said catch elements, said engaging-element, when not in locking engagement with either of said catch elements, being non-contiguous with both of said catch elements, and at least one of said catch elements further comprising a catch housing and an integrally formed clasp mechanism, said clasp mechanism of said catch element being adapted to attach said catch element to an external device, said external device however not being said engaging-element or the other of said catch elements.

13. A tamper-evident seal as in claim 12 wherein at least one of said catch elements comprises a catch housing and a top arm and a bottom arm, said top arm having a first end joined to said catch housing and a second end, said bottom arm having a first end joined to said catch housing and a second end, said second end of said top arm and said second end of said bottom arm being spaced apart, and said second end of said top arm and said second end of said bottom arm being adapted to interlock when said second end of said top arm and said second end of said bottom arm are forcibly pressed together.

14. A tamper-evident seal as in claim 13 wherein said upper and lower arms are asymmetric.

15. A tamper-evident seal as in claim 14 wherein said upper and lower arms are unequal in length.

16. A tamper-evident seal as in claim 12 wherein said clasp mechanism of said catch element, after said catch element has been attached to said external device, is cemented.

17. A tamper-evident seal as in claim 12 wherein said clasp mechanism of said catch element, after said catch element has been attached to said external device, is welded.

* * * * *